US009355764B2

(12) United States Patent
Tolbert et al.

(10) Patent No.: US 9,355,764 B2
(45) Date of Patent: May 31, 2016

(54) MAGNETOELECTRIC CONTROL OF SUPERPARAMAGNETISM

(71) Applicant: THE REGENTS OF THE UNIVERSITY OF CALIFORNIA, Oakland, CA (US)

(72) Inventors: Sarah H. Tolbert, Los Angeles, CA (US); Gregory P. Carman, Los Angeles, CA (US); Scott Keller, Long Beach, CA (US); Laura Schelhas, Los Angeles, CA (US); Hyungsuk Kim, Los Angeles, CA (US); Joshua Hockel, Los Angeles, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 208 days.

(21) Appl. No.: 14/155,283

(22) Filed: Jan. 14, 2014

(65) Prior Publication Data

US 2014/0197910 A1 Jul. 17, 2014

Related U.S. Application Data

(60) Provisional application No. 61/752,110, filed on Jan. 14, 2013.

(51) Int. Cl.
*H01F 1/00* (2006.01)

(52) U.S. Cl.
CPC ..... *H01F 1/0036* (2013.01); *H01F 1/0063* (2013.01); *H01F 1/0018* (2013.01)

(58) Field of Classification Search
CPC ..... H01F 1/0063
See application file for complete search history.

(56) References Cited

U.S. PATENT DOCUMENTS 7,105,118 B2 * 9/2006 Narayan ..... B82Y 10/00 257/E29.071

OTHER PUBLICATIONS

Ortega, N. et al. "Investigation of temperature-dependent polarization, dielectric, and magnetization behavior of multiferroic layered nanostructure," Thin Solid Films 519 (Aug. 25, 2010) pp. 641-649.
Hansen and Morup "Estimation of blocking temperatures from ZFC/FC curves," Journal of Magnetism and Magnetic Materials 203 (1999) 214-216.
Bedanta and Kleemann, "Supermagnetism," J. Phys. D: Appl. Phys. 42, Dec. 5, 2008, 013001 (28pp).
Ryu et al. "Magnetoelectric Effect in Composites of Magnetostrictive and Piezoelectric Materials" Journal of Electroceramics, 8, 107-119, 2002.
Chen et al. "Preparation and magnetic properties of nickel nanoparticles via the thermal decomposition of nickel organometallic precursor in alkylamines" Nanotechnology 18 (Nov. 20, 2007) 505703 (6pp).

(Continued)

*Primary Examiner* — Mohamad Musleh
(74) *Attorney, Agent, or Firm* — O'Banion & Ritchey LLP; John P. O'Banion

(57) ABSTRACT

A magnetoelectric composite device having a free (i.e. switchable) layer of ferromagnetic nanocrystals mechanically coupled a ferroelectric single crystal substrate is presented, wherein application of an electrical field on the composite switches the magnetic state of the switchable layer from a superparamagnetic state having no overall net magnetization to a substantially single-domain ferromagnetic state.

21 Claims, 6 Drawing Sheets

(56) References Cited

OTHER PUBLICATIONS

Weiler et al. "Voltage controlled inversion of magnetic anisotropy in a ferromagnetic thin film at room temperature" New Journal of Physics 11 (Jan. 16, 2009) 013021 (16pp).
Rottmayer et al. "Heat-Assisted Magnetic Recording" IEEE Transactions on Magnetics, vol. 42, No. 10, Oct. 2006.
Lee and Kang "Design Consideration of Magnetic Tunnel Junctions for Reliable High-Temperature Operation of STT-MRAM" IEEE Transactions on Magnetics, vol. 46, No. 6, May 19, 2010.
Lee and Kang "Development of Embedded STT-MRAM for Mobile System-on-Chips" IEEE Transactions on Magnetics, vol. 47, No. 1, Jan. 2011.
Yoon, M. et al. "Superparamagnetic properties of nickel nanoparticles in an ion-exchange polymer film" Materials Chemistry and Physics 91 (2005) 104-107.
Mitra and Mandal, "Superparamagnetic Behavior in Noninteracting NiFe2O4 Nanoparticles Grown in SiO2 Matrix" Materials and Manufacturing Processes, 22: 444-449, Apr. 10, 2007.
M. P. Curie, "Sur La Symétrie Dans Les Phénomènes Physiques, Symétrie D'Un Champ Électriglue Et D'Un Champ Magnétique" Journal de Physique Théorique et Appliquée 1894, 3, 393-415, original article in French pp. 1-23, English translation pp. 24-39 (pp. 1-39).
Murakami, M. et al. "Tunable multiferroic properties in nanocomposite PbTiO3—CoFe2O4 epitaxial thin films" Applied Physics Letters 87, 112901, Sep. 6, 2005.
Wan et al. "Electric-field-induced magnetization in Pb,,Zr,Ti . . . O3/Terfenol-D composite structures" Applied Physics Letters 88, 182502 May 3, 2006.
Chung, et al. "Reversible magnetic domain-wall motion under an electric field in a magnetoelectric thin film" Mar. 20, 2008, Applied Physics Letters 92, 112509.
Chung, et al. "Electric-field-induced reversible magnetic single-domain evolution in a magnetoelectric thin film" Applied Physics Letters 94, 132501, Mar. 31, 2009.
Yang, et al. "Electric field manipulation of magnetization at room temperature in multiferroic CoFe2O4/Pb,,Mg1/3Nb2/3)0.7Ti0.3O3 heterostructures" May 27, 2009, Applied Physics Letters, 94, p. 212504.
Wu, T. et al. "Electrical control of reversible and permanent magnetization reorientation for magnetoelectric memory devices," Jun. 30, 2011, Applied Physics Letters 98, p. 262504.
Jun, et al. "Nanoscaling Laws of Magnetic Nanoparticles and Their Applicabilities in Biomedical Sciences," Accounts of Chemical Research vol. 41, No. 2 Feb. 19, 2008, pp. 179-189.
McDaniel, T.W., "Ultimate limits to thermally assisted magnetic recording," J. Phys.: Condens. Matter 17 (Feb. 4, 2005) R315-R332.
Leslie-Pelecky and Rieke "Magnetic Properties of Nanostructured Materials" Chem. Mater., vol. 8, No. 8, 1996, pp. 1770-1783.
Chen and Wu, "Synthesis of Nickel Nanoparticles in Water-in-Oil Microemulsions," Chem. Mater., vol. 12, No. 5, Apr. 5, 2000, pp. 1354-1360.
Knobel, et al. "Superparamagnetism and Other Magnetic Features in Granular Materials: A Review on Ideal and Real Systems," Journal of Nanoscience and Nanotechnology vol. 8, 2836-2857, 2008.
M. Amère, Brief Presented at the Royal Academy of Sciences, Oct. 2, 1820, English translation (pp. 1-21), original in French (pp. 1-73) pp. 1-94.
Shevchenko, et al. "Structural Characterization of Self-Assembled Multifunctional Binary Nanoparticle Superlattices," J. Am. Chem. Soc. vol. 128, No. 11, Feb. 24, 2006.
Bean and Livingston, "Superparamagnetism," Journal of Applied Physics, vol. 30, No. 4. Apr. 1959.
Cowburn, "Superparamagnetism and the future of magnetic random access memory," Journal of Applied Physics, vol. 93, No. 11, Jun. 1, 2003.
Hu, et al., "Electric-field control of strain-mediated magnetoelectric random access memory," J. Appl. Phys. 107, p. 093912, May 6, 2010.
Bur, et al. "Strain-induced magnetization change in patterned ferromagnetic nickel nanostructures," J. Appl. Phys. 109, p. 123903, Jun. 17, 2011.
Wu, et al. "Domain engineered switchable strain states in ferroelectric (011) [Pb(Mg1/3Nb2/3)O3](12x)-[PbTiO3]x (PMN-PT, x0.32) single crystals" J. Appl. Phys. 109, p. 124101, Jun. 16, 2011.
Kryder, M.H., et al. "Heat Assisted Magnetic Recording" Proceedings of the IEEE, vol. 96, No. 11, Nov. 2008, pp. 1810-1835.
Kim, et al. "Synthesis and characterization of surfactant-coated superparamagnetic monodispersed iron oxide nanoparticles" Journal of Magnetism and Magnetic Materials, 225 (2001) pp. 30-36.
Skumryev, et al. "Beating the superparamagnetic limit with exchange bias," Nature, vol. 423, Jun. 19, 2003.
Ramesh and Spaldin, "Multiferroics: progress and prospects in thin films," nature materials, vol. 6, Jan. 2007.
Chu, et al. "Electric-field control of local ferromagnetism using a magnetoelectric multiferroic," nature materials, Apr. 27, 2008, vol. 7.
Tamion, et al. "Magnetic anisotropy of embedded Co nanoparticles: Influence of the surrounding matrix," Physical Review B 81, p. 144403 (2010).
Yamasaki, et al., "Magnetic Reversal of the Ferroelectric Polarization in a Multiferroic Spinel Oxide" Physical Review Letters, vol. 96, (May 26, 2006).

* cited by examiner

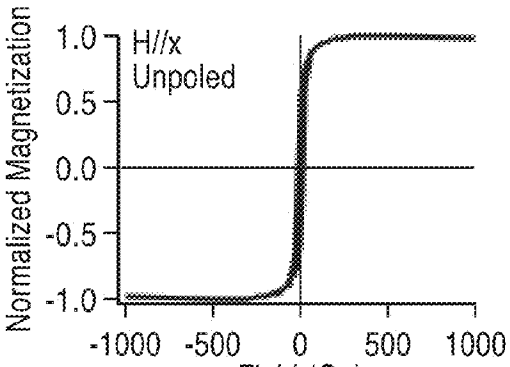
FIG. 5A
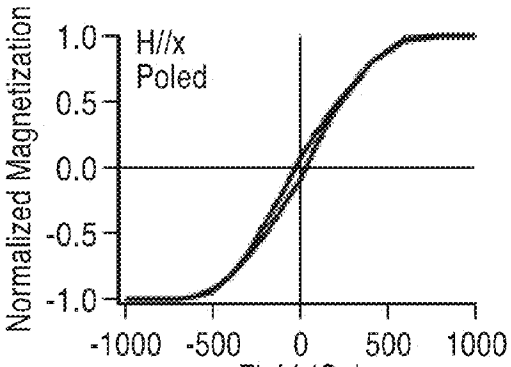
FIG. 5C
FIG. 5B
FIG. 5D

MAGNETOELECTRIC CONTROL OF SUPERPARAMAGNETISM

CROSS-REFERENCE TO RELATED APPLICATIONS

This application claims the benefit of, and priority to, U.S. provisional patent application Ser. No. 61/752,110 filed on Jan. 14, 2013, incorporated herein by reference in its entirety.

STATEMENT REGARDING FEDERALLY SPONSORED RESEARCH OR DEVELOPMENT

This invention was made with Government support under CHE1112569, awarded by the National Science Foundation, and FA9550-09-1-0677, awarded by the U.S. Air Force, Air Force Office of Scientific Research. The Government has certain rights in the invention.

INCORPORATION-BY-REFERENCE OF COMPUTER PROGRAM APPENDIX

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to electromagnetic devices, and more particularly to multiferroic electromagnetic devices.

2. Description of Related Art

Electromagnetic devices, including antennas, motors, and memory, generally rely on extrinsic coupling produced by passing an electrical current through a wire to generate a magnetic field. While extremely successful in the large scale, this approach suffers from significant problems in the small scale where resistive losses are preventing further device miniaturization. An intrinsic approach has been sought to electrically control magnetization, and some minor progress has been made using electric field induced strain to modulate magnetization in multiferroic composite materials. However, these "bulk" multiferroic materials contain multi-domain magnetic structures that produce marginal magnetization changes with the application of an electric field. Recent developments have focused on nanoscale elements, using electric field induced strain to control a single magnetic domain. To date, however, only domain reorientation (i.e. electric fields only reorient the magnetization state) has been achieved and researchers have not been able to use magnetoelectric coupling to control the overall magnetic state of the material (i.e. change its magnitude to turn on or off net magnetization).

One roadblock to achieving miniaturization of magnetic devices is superparamagnetism, and so efforts have been made to control this transition. As the size of magnetic materials decreases, ambient thermal energy becomes higher than intrinsic magnetic anisotropies, resulting in randomization of magnetic orientations and no net time averaged magnetization. Attempts to modulate superparamagnetism have been made using exchange-biasing to shift the superparamagnetic transition temperature. For memory applications, where transient excursions toward the superparamagnetic limit could reduce write energies, heat assisted magnetic memory is also an option that has been considered. For exchange-bias materials, unfortunately the coupling results in only a shift in transition temperature and not control over the magnetic state of the material.

BRIEF SUMMARY OF THE INVENTION

An aspect of the present invention is a system and method to intrinsically control the net observed magnetization state via magnetoelectric control of superparamagnetism, which occurs in nanoscale ferromagnetic crystals when the ambient thermal noise is larger than the magnetic anisotropy resulting in a zero magnetization state.

Another aspect is a multiferroic system having an electric-field-induced anisotropy capable of electrically switching between a superparamagnetic state and a single-domain ferromagnetic state at constant temperature, thus representing an intrinsic approach to turn on and off a net magnetic field. This electrical modulation of magnetism can be achieved (but is not limited to) via an electric-field-induced strain in a magnetoelectric composite composed of two material phases, one superparamagnetic and one dielectric (and in particular, ferroelectric or piezoelectric). The voltage induces a change of state for the superparamagnetic material causing it to behave as a ferromagnet. An example of one such system is composed of Ni nanocrystals mechanically coupled to an oriented PMN-PT single crystal. This uniquely provides a system where an electric field is used to turn on and off a permanent magnetic moment, significantly advancing the field of electromagnetic devices.

One embodiment of the invention is a system having electric-field induced magnetic anisotropy in a multiferroic composite, and in particular containing nickel nanocrystals strain coupled to a piezoelectric substrate. This system can be switched between a superparamagnetic state (no overall net magnetization) and a single-domain ferromagnetic state at room temperature. Strain transfer from the substrate to the magnetic component of the system results in perturbation of the magnetization of the system. The system shows a significant and controllable shift in the blocking temperature. For the Ni nanocrystal system discussed, a change of approximately of 40K upon application of an electric field is observed.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

FIG. 5A through FIG. 5D show magnetic hysteresis curves obtained on nickel nanocrystals of the present invention embedded in Pt thin film on top of (011) PMN-PT at 298 K. FIG. 5A and FIG. 5B show data measured with the magnetic field applied parallel to the x- and y-axes, respectively on the unpoled sample. FIG. 5C and FIG. 5D show data measured with the magnetic field applied parallel to the x- and y-axes, respectively on the poled sample.

Figure 6A:
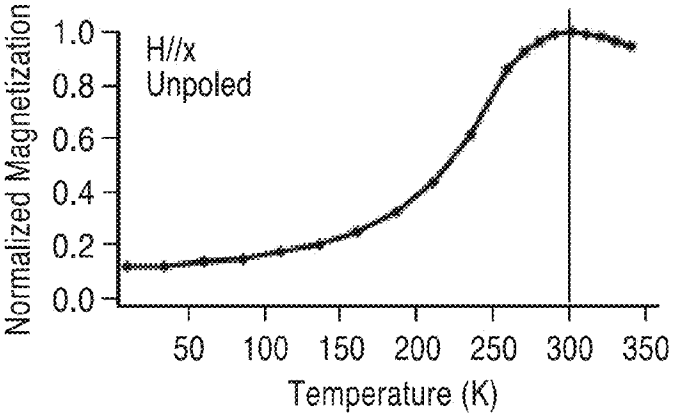
Figure 6C:
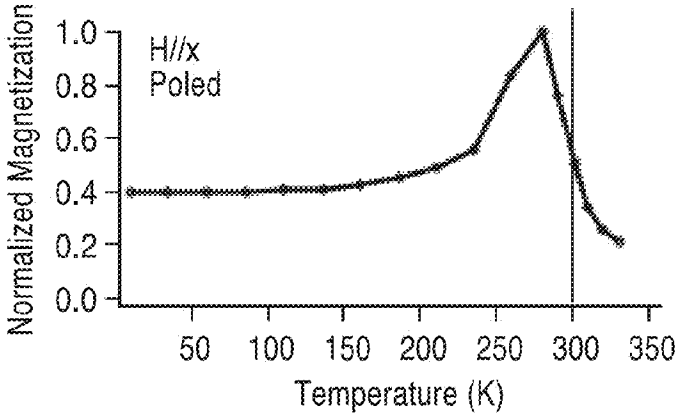
Figure 6B:
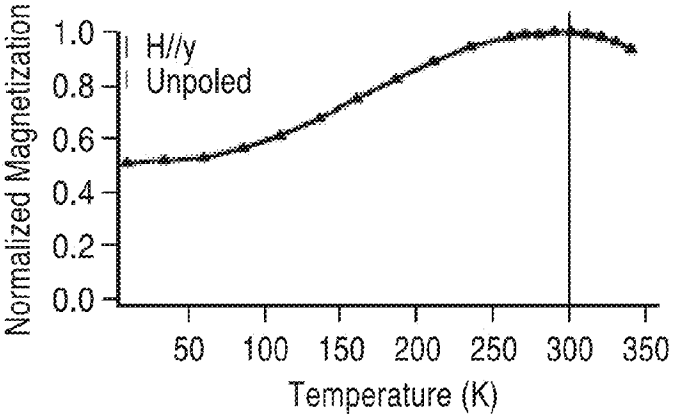
Figure 6D:
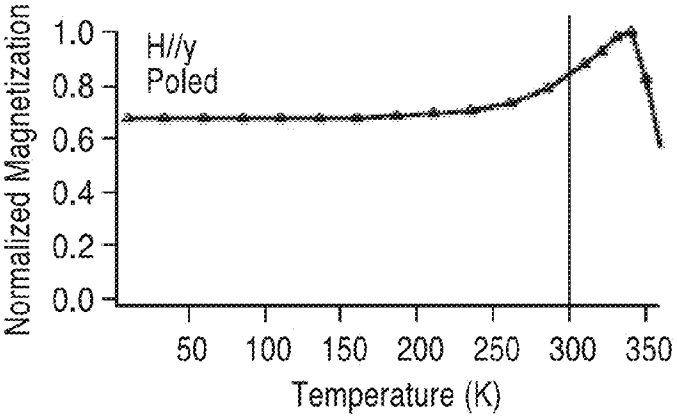

FIG. 6A through FIG. 6D show zero field cooled (ZFC) magnetization curves as a function of temperature for Ni nanocrystals embedded in Pt on (011) PMN-PT before and after electrical poling in accordance with the present invention. All data is normalized to 1 at the peak magnetization. FIG. 6A and FIG. 6B show data on the unpoled sample, measured in the x- and y-directions, respectively. FIG. 6C and FIG. 6D show data on the poled sample, again measured in x- and y-directions, respectively. All curves were measured using a 50 Oe applied field. The line drawn at 300K is intended as a guide to the eye.

Figure 7:
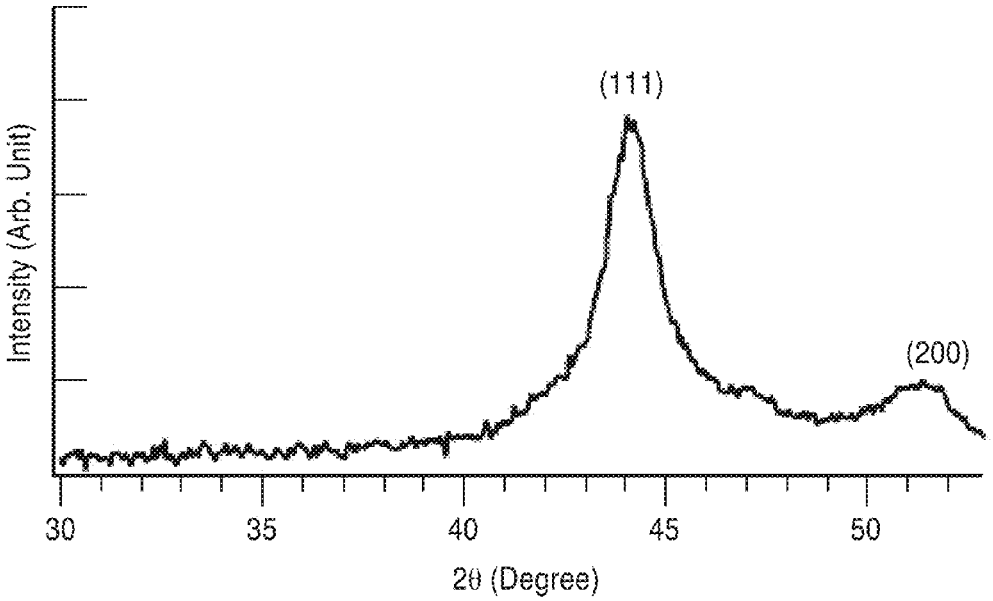

FIG. 7 is a plot of powder XRD obtained on as synthesis Ni nanocrystals. Peaks correspond to the FCC crystal structure of Ni and peak positions are in agreement with JCPDS card #4-850.

Figure 8:
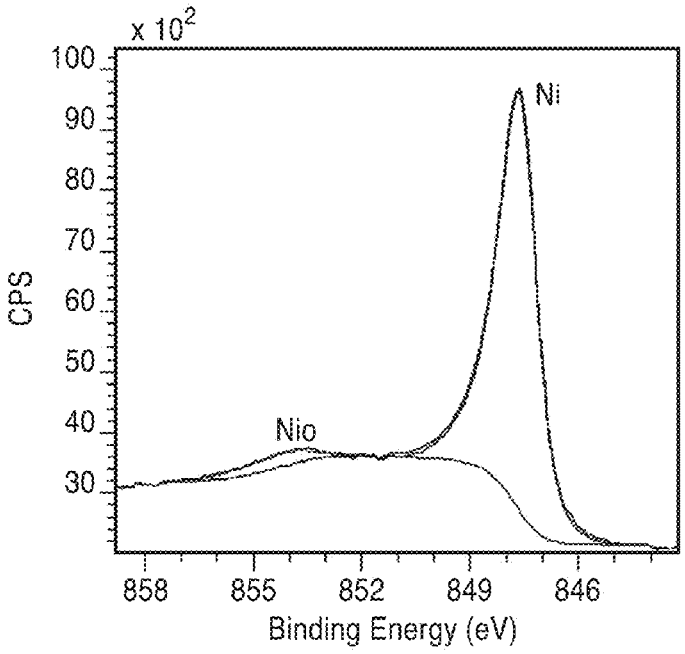

FIG. 8 is a plot showing XPS depth-profiling data on Ni nanocrystals embedded in Pt on top of a PMN-PT substrate. For this data, Ar ion etching was used to remove the top Pt layers of the sample, exposing the Ni nanoparticles. The data show only minimal oxidation of the Ni nanocrystals embedded in the Pt; fitting of the Ni 2p peaks gives 5% NiO and 95% Ni.

DETAILED DESCRIPTION OF THE INVENTION

In the embodiments disclosed below, superparamagnetism is used to intrinsically control the net magnetization of the magnetoelectric system of the present invention. The superparamagnetism occurs in nanoscale ferromagnetic crystals when the ambient thermal energy is larger than the magnetic anisotropy, resulting in a zero magnetization state. While the systems and methods of the present invention are primarily embodied below in one combination of materials (e.g. Ni nanocrystals on a piezoelectric PMN-PT substrate) it is appreciated that the principles of the present invention may be broadly applied to any class of small magnetic nanostructures strain or charge coupled to any ferroelectrics/piezoelectrics.

Figure 1:
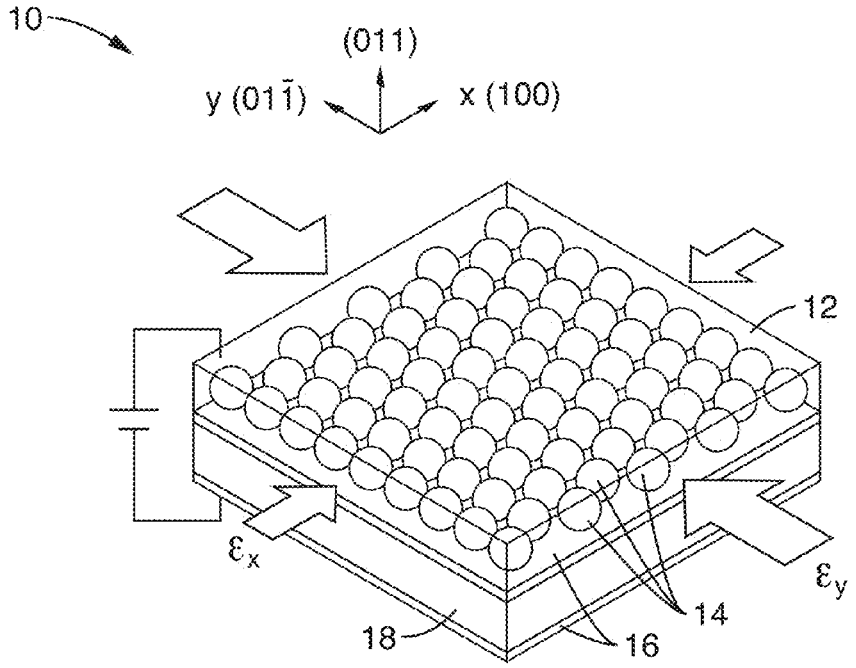
FIG. 1 shows a perspective schematic diagram of a magnetoelectric composite device in accordance with the present invention.

FIG. 1 shows a perspective schematic diagram of a magnetoelectric composite device 10 in accordance with the present invention composed of a free (i.e. switchable) layer 12 of ferromagnetic nanocrystals mechanically coupled to a (011) $[Pb(Mg_{1/3}Nb_{2/3}O_3]_{(1-x)}$—$[PbTiO_3]_x$ (PMN-PT, x≈0.32) ferroelectric single crystal substrate 18 (fixed layer). In a preferred embodiment, layer 12 comprises a 30 nm thickness Pt layer (drawn partially transparent in FIG. 1 for clarity) comprising a plurality of 16 nm diameter Ni nanocrystals 14. Electrodes 16 (preferably 10 nm thick Ti) evaporated on the top and bottom of the substrate 18. In a preferred embodiment, substrate 18 comprises 500 μm thick (011) oriented PMN-PT single crystal substrate. It is appreciated that layer 12 may comprise a superparamagnetic element comprising a single nanoparticle or structure, and that substrate 18 may comprise a number of dielectric elements.

Figure 2:
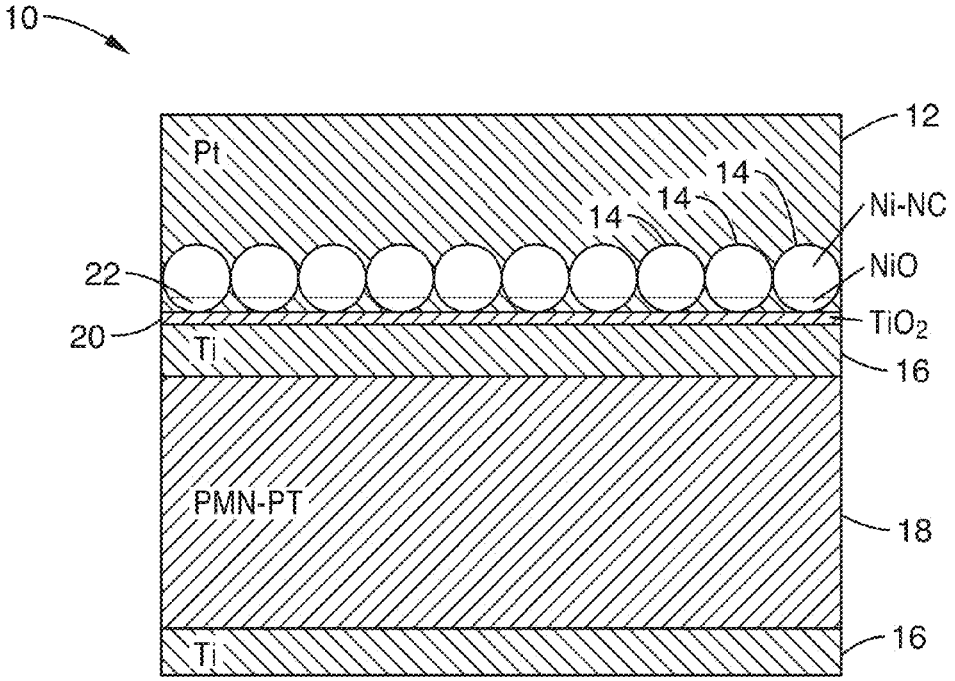
FIG. 2 shows a detailed schematic side view of the magnetoelectric composite device of FIG. 1.

FIG. 2 shows a more detailed schematic side view of the magnetoelectric composite device 10, illustrating the adhesion of Ni nanocrystals 14 to the substrate 18. The upper evaporated Ti electrode 16 will oxidize to comprise a $TiO_2$ 20. Furthermore, deposited Ni nanocrystals 14 oxidize slightly to comprise a NiO layer 22 when deposited on $TiO_2$ layer 20 creating adhesion between the NiO 22 and the $TiO_2$ surface 20

As illustrated in FIG. 1, arrows $\in_x$ and $\in_y$ indicate the direction of induced anisotropic strain generated as a result of poling with applied voltage V.

The nanocrystals were synthesized via thermal decomposition of 1 mmol Nickel acetylacetonate in the presence of oleylamine (7 ml), oleic acid (2 mmol), and trioctylphosphine (2 mmol). Optimized conditions for the synthesis are summarized below. The solution was stirred at room temperature for 20 minutes under gentle Ar flow before heating first to 130° C. for 30 min, and then to 240° C. (reflux) for 30 min. The solution was then cooled, and the particles were precipitated with ethanol and centrifuged. Two further washings were done with ethanol and hexane followed by centrifugation to remove any unbound ligands. The particles were stored dissolved in hexane under Argon. The above synthesis method represents one illustrative approach to produce superparamagnetic particles, however it is appreciated that such synthesis may be achieved using a number of methods available in the art.

Deposition of Ni nanoparticles onto PMN-PT substrates was done using a slow evaporation technique. The (011) oriented PMN-PT single crystal ferroelectrics were manufactured by Atom Optics CO., LTD. (Shanghai, China). The substrate was angled between 60-70° in a vial containing a dilute solution of Ni nanocrystals dispersed in hexanes. Gentle heat of approximately 80° C. was applied to facilitate evaporation along with a gentle Ar flow to prevent oxidation of the Ni nanocrystals. Argon plasma etching and Pt sputtering was done using a Hummer 6.2 from Anatech.

Figure 3A:
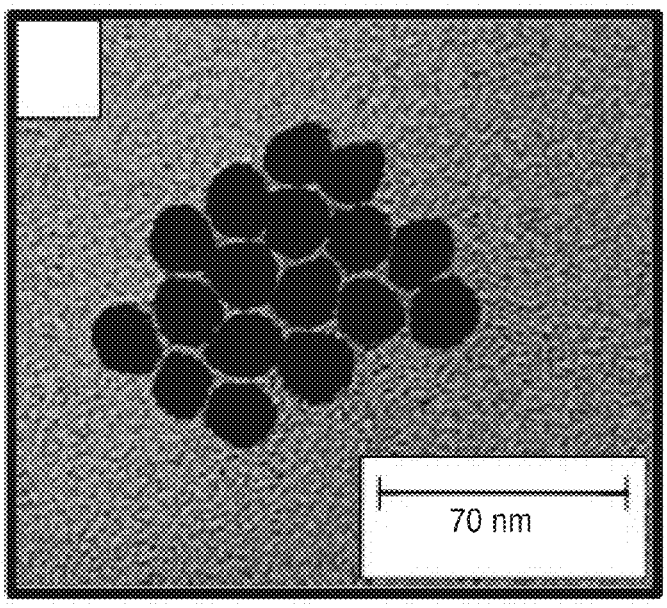
FIG. 3A shows a TEM image of several as-synthesized Ni nanocrystals in accordance with the present invention. The average nanocrystal diameter is ~16 nm and particles are approximately spherical and non-agglomerated.

FIG. 3A shows a TEM image of the as-synthesized Ni nanocrystals, indicating that they are both spherical and fairly monodispersed in size. X-ray diffraction data obtained on the Ni nanocrystals (FIG. 7) shows an FCC structure (JCPDS #4-850), consistent with literature reports. Magnetoelectric composites were produced by slowly evaporating a dilute solution of the Ni nanocrystals dissolved in hexane onto an unpoled PMN-PT substrate coated with a thin titanium adhesion layer in an Ar atmosphere.

Figure 3B:
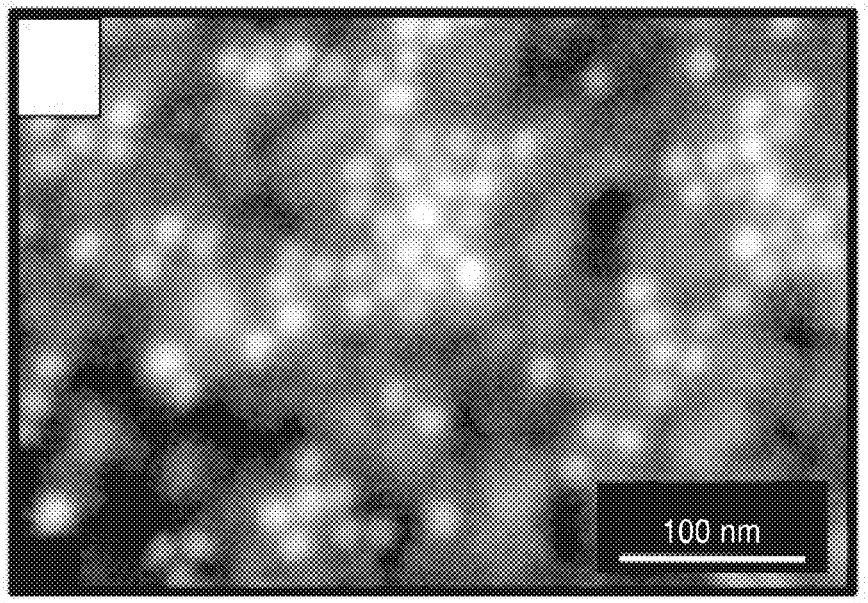
FIG. 3B shows an SEM micrograph of the nanocrystals of the present invention after deposition onto the piezoelectric substrate. Sub-monolayer coverage of non-agglomerated nanocrystals is observed.

An SEM image of the particles deposited onto the substrate is shown in FIG. 3B, demonstrating that a homogeneous sub-monolayer distribution is produced. The organic ligands on the particles were subsequently removed in an inert atmosphere using a two-minute argon plasma etch. Without breaking vacuum, a 30 nm thick Pt layer 12 was deposited onto the PMN-PT substrate 18 to fully encase the Ni particles 14 and protect them from oxidation (as shown in FIG. 1). The Pt layer 12 also provides a load transfer path from the PMN-PT substrate 18 to the Ni nanocrystals 14. XPS depth profiling analysis (see FIG. 8) of the magnetoelectric composite indicates that the Ni nanoparticles 14 are well preserved throughout this process, and that only a small amount of oxidation occurs (XPS Ni 2p peak analysis shows 95% Ni, 5% NiO). This slight oxidation of the Ni nanocrystals (e.g. layer 22 shown in FIG. 2) allows for good adhesion to the surface of the substrate through the NiO bond formation. This adhesion is beneficial to help facilitate strain transfer to the particles: e.g. when the nanocrystals are deposited on oxide-free Pt substrates rather than Ti/$TiO_x$ substrates, the desired results reported herein are not observed, suggesting that interfacial bond formation is part of the strain transfer process between the piezoelectric substrate and the nanocrystals.

Figure 4:
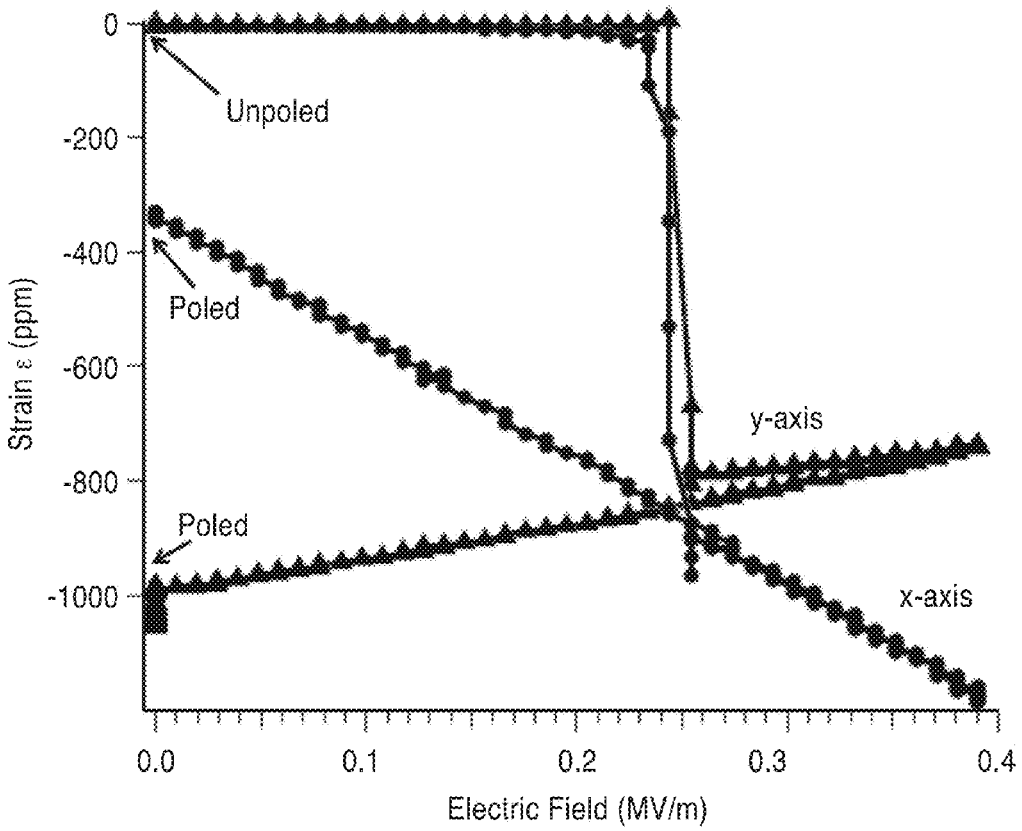
FIG. 4 shows a plot of the strain induced in PMN-PT via an electric field applied along the (011) direction. Triangles indicate strain along the y-axis, and circles along the x-axis.

Magnetic measurements on the magnetoelectric sample were performed before and after poling the PMN-PT substrate 18 at room temperature. Note that measurements could be done as a function of different electric fields in addition to just simply poling the sample. FIG. 4 shows the anisotropic in-plane (x-y plane) strains generated as a function of applied electric field measured using a bi-directional strain gauge attached to the sample. In the unpoled state, the Ni particles in the magnetoelectric sample are subjected to negligible strains ($\in_x=\in_y=0$). During the poling schematically illustrated in FIG. 1 (i.e. E=0.4 MV/m), compressive strains up to $\in_x=-1200\mu\in$ and $\in_y=-800\mu\in$ are produced. Upon removal of the electric field, large anisotropic compressive strains of $\in_x=-300\mu\in$ and $\in_y=-1000\mu\in$ are present in the poled state. Since Ni has a negative magnetostriction coefficient, any induced magnetoelastic anisotropy causes the magnetic dipoles in the single domain Ni nanocrystals to align along the dominant compressive strain direction (which corresponds to the deeper energy well). For the poled state, the larger anisotropic strain along the y-axis direction produces this deeper energy well. It is appreciated that the superparamagnetic element may also be configured to comprise a positive magnetostriction coefficient to cause the magnetic dipoles in the nanoparticles to align perpendicular to the dominant compressive strain direction.

FIG. 5A through FIG. 5D show room temperature magnetic moment (M) measurements as a function of the applied magnetic field (H). FIG. 5A and FIG. 5B show the unpoled (i.e. $\in_x=\in_y=0$) magnetoelectric composites measured in x- and y-directions, respectively. Measurements were conducted using a superconducting quantum interference device (SQUID, Quantum Design, MPMS XL-5). Similar, small coercive fields, $H_c<20$ Oe, are observed in both directions indicating that the sample is both magnetically isotropic in-plane and dominantly superparamagnetic (i.e. they show near zero net magnetization). The small anisotropies observed are attributed to small variations in the spatial distribution of nanocrystals produced during the evaporative deposition process used to manufacture the magnetoelectric composite and are typical of magnetic measurements on arrays of superparamagnetic nanocrystals.

FIG. 5C and FIG. 5D show similar magnetic measurements on the poled ($\in_x=-300\mu\in$, $\in_y=-1000\mu\in$) magnetoelectric composite. The data in panel FIG. 5C shows that a hard magnetic axis is created parallel to the x-direction for the poled sample with a magnetic anisotropy ($H_a$) of 600 Oe. The ratio of the remnant magnetization ($M_r$) to the saturation magnetization ($M_s$) is very low, suggesting that domains tend to orient in an off-axis direction.

In contrast, FIG. 5D shows a magnetic easy axis is created along the y-direction for the poled sample. In this direction, $M_r$ is approximately equal to $M_s$, indicating that the sample consists of essentially single domain Ni nanocrystals that are aligned along the y-axis. Furthermore, $H_c=80$ Oe measured along this direction which confirms a deeper potential well for spin alignment is present in the y-direction after application of an electric field. This result thus demonstrates that the application of an electric field stabilized the y-axis aligned spin state, resulting in a net magnetization equivalent to the saturation magnetization of Ni (i.e. 485 emu/cc). Rephrased, this result shows that we can use an applied electric field to "turn on" a net magnetization.

FIG. 6A and FIG. 6B show normalized magnetic moments as a function of temperatures for unpoled magnetoelectric samples. Samples were initially cooled to 10 K in the absence of a magnetic field (zero field cooling, ZFC) followed by measurement of the magnetic moment as a function of temperature in a 50 Oe applied field. The temperature corresponding to the highest magnetic moment is typically defined as the blocking temperature ($T_b$), above which magnetic dipoles begin to lose their directionality due to thermal randomization and the sample becomes superparamagnetic. There are some small differences in the data measured in the x- and y-directions, which are attributed to the evaporative deposition process, as discussed previously. Nonetheless, similar blocking temperatures of ~300 K are found in the unpoled state in both directions.

By contrast, FIG. 5C and FIG. 5D show ZFC curves for the poled magnetoelectric sample measured along the x- and y-directions, respectively. The data measurements in the x-direction (hard axis) shows a peak at 280 K, which represents a decrease of 20 K compared to the peak observed in the unpoled samples (FIG. 6A and FIG. 6C). More dramatically, for the y-direction (easy-axis) the peak of the magnetization curve (or $T_B$) increases to 340 K, or a change of 40 K when compared to the peak in the unpoled samples.

The shifts in the maximum of the ZFC curves can be explained by considering how the potential landscape for spin alignment is changed in an anisotropically strained sample. In the unpoled sample, the magnitude of the barrier for spin flip is on the order of the available thermal energy at room temperature and so the spins begin to hop between magnetic easy axes as the blocking temperature of 300 K is approached. When the sample is anisotropically strained by the PMN-PT substrate, however, the potential well for spin alignment in the y-direction is deepened. It thus requires significantly more thermal energy for the spins to hop out of this deeper well, and so the blocking temperature shifts to well above room temperature (340 K) after electric poling. In the x-direction, the blocking temperature appears to decrease, but this is not a true blocking temperature, as the fall-off in magnetization at 280 K is not thermal randomization of magnetic moments, but rather magnetization transfer from the x-direction to the y-direction as the system obtains sufficient thermal energy to free the spins from the metastable potential minima where they were trapped. Because spins are directionally transferring from a high energy configuration to a lower energy configuration, the process occurs at a lower temperature than the thermal randomization observed in the unpoled sample. The true blocking temperatures in the unpoled and poled system are thus 300 and 340 K respectively.

This result thus confirms the experimental results shown in FIG. 5, which indicate that the electric field can be used to stabilize the ferromagnetic spin state at room temperature. This is accomplished by moving the blocking temperature from a value very near room temperature, to a value well above room temperature.

The above conclusions can be validated using the Arrhenius-Neel equation:

$$\frac{1}{\tau} = \frac{1}{\tau_0} e^{\frac{-KV}{k_B T}}, \quad \text{(Eq. 1)}$$

where $\tau$ is the magnetization switching time, K is total anisotropy energy density, V is particle volume, $k_B$ is Boltzman's constant, T is the temperature, and $$\frac{1}{\tau_0}$$

is the attempt frequency. Using $$\frac{1}{\tau_0} = 10^9/\text{second and } T = 100 \text{ seconds}$$

produces the familiar $KV=25k_BT$ relation. For the system 10 of the present invention, the electric-field-induced change in the magnetoelastic anisotropy is approximated by $\frac{3}{2}\lambda Y \Delta\in_a$, where $\lambda=-34\mu\in$ is the Ni magnetostrictive constant, Y=213.7 GPa is the Ni Young's modulus and $\Delta\in_a=-700\mu\in$ is the residual strain induced in the Ni nanocrystal after electric poling (see FIG. 4). Incorporating this anisotropy term into the Arrhunius-Neel equation (Eq. 1) produces $\frac{3}{2}\lambda Y \Delta\in_a=25k_B\Delta T_B$, which provides an estimate of the blocking temperature change $\Delta T_B$ that should result from the additional magnetoelastic energy added during electric poling. The calculated value of 46 Kelvin is in excellent agreement with the measured value of ~40 K.

A particularly beneficial feature of the system 10 of the present invention is the fundamental ability to control not only the direction, but also the magnitude of a spin state using an electric field. Based on these features, system 10 of the present invention has significant applicability to miniaturization of a wide class of electromagnetic devices. Consider, for example, application of the system 10 as Magnetic Random Access Memory (MRAM), which currently faces two major engineering challenges to reduce size: 1) overcoming the thermal instability associated with nanoscale magnetic elements and 2) reducing the write energy to encode a bit of information. In the former case, the superparamagnetic transition behavior defines the smallest bit size while for the latter case; larger write energies require larger fields and thus larger write heads or other routes to reduce fields.

The multiferroic system 10 of the present invention provides a solution to both of these problems, which yields further miniaturization. By electrically increasing the magnetic anisotropy, as demonstrated above, the minimum size of a stable bit of information can be reduced.

Furthermore, since the magnetic anisotropy is electrically generated, the anisotropy can be modulated using an electrical field, thus providing an avenue to create bits that are magnetically hard and thus thermally stable when written, but can be electrically switched to a magnetically soft state that is easy to reorient for the write process.

To see this process more concretely, consider the data in panel d of FIG. 5, which shows a coercive field of the poled sample is $H_c$=80 Oe, corresponding to the stabilized nanoscale bit. Examination of FIG. 4 indicates that application of a 0.24 MV/m electric field reduces the magnetoelectric anisotropy to zero (i.e. $\in_x=\in_y$ or $\Delta\in_a=0$), returning the sample to near the superparamagnetic state ($H_c$<20 Oe). A transient bias can thus be used to reduce anisotropy during the write step. In this way, the systems and methods of the present invention provide an electrical mechanism to both increase the blocking temperature, and decrease magnetic write energies, a combination that is simply not possible in conventional magnetic systems.

By applying electric-field-induced strain to the ferromagnetic nanocrystals, it has been demonstrated that a superparamagnetic Ni nanocrystal with no permanent magnetic moment at room temperature can be converted to strong single-domain ferromagnets, again at room temperature, through application of an electric field, thus providing a novel approach for controlling magnetism at the small scale. The intrinsic control of magnetization demonstrated above manifests itself as an electric field induced shift in the blocking temperature of approximately 40 degrees Kelvin for 16 nm Ni nanocrystals. The system 10 of the present invention may be used to create new types of electromagnetic devices, as well as transitioning conventional devices down to length scales too small to effectively exploit standard electromagnetic coupling.

Instrumentation: Transmission electron microscopy (TEM) images were obtained using an FEI/PHILIPS CM120 electron microscope operating at 120 kV, as well as a JEOL-2100 electron microscope operating at 200 kV. Scanning electron microscopy (SEM) images were obtained using a JEOL model 6700F electron microscope with beam energy 5 kV. 2D-WAXD measurements were carried out on a D8-GADDS diffractometer from Bruker instruments (Cu K$\alpha$ radiation) equipped with an energy dispersive solid-state detector. XPS analysis was performed using a Kratos Axis Ultra DLD with a monochromatic K$\alpha$ radiation source. The charge neutralizer filament was used to control charging of the sample. A 20 eV pass energy was used with a 0.05 eV step size. Scans were calibrated using the C 1s peak shifted to 294.8 eV.

The methods detailed above are representative of a preferred approach to fabricating the magnetoelectric composite device of the present invention. It is appreciated that the other methods may be used to implement the system of the present invention, including but not limited to:

(a) synthetic nanocrystal deposition by: spin coating, dip coating, roll-to-roll deposition, or spraying; (b) adhesion between nanocrystals and the substrate generated by: ligand stripping the nanocrystals in solution followed by deposition, or ligand stripping the nanocrystals after deposition on the substrate, as detailed above, creating functional ligands to provide a bond between the nanocrystals and the piezoelectric substrate, or using reactive interface layers to create a bond between the nanocrystals and the substrate.

Other possible methods for nanoparticle synthesis on the piezoelectric substrate include: lithography, e-beam deposition, or template deposition (e.g. using porous templates such as anodic alumina, block copolymers, or porous inorganic materials).

The system 10 of the present invention utilizes electric field modulation of the superparamagnetic transition temperature. This allows for an electrically controlled transition from a nonmagnetic state to a magnetic state. This result has been realized with just one combination of materials as described above (Ni nanocrystals, PMN-PT substrate); however, this result should be feasible with many different combinations of materials as well as many different forms of coupling. E.g. strain coupling is primarily detailed above, but charge coupling may also be used. The intrinsic control of magnetization is a function of the properties of the materials and is not limited to the specific materials used in this proof of principle experiment.

Additionally, other materials that may be used include, but are not limited to:

1. Use of other dielectrics, including ferroelectric/piezoelectric substrates (e.g. lead zirconium titanate (PZT), barium titanate, various niobates such as lithium niobate, sodium niobate, or lead magnesium niobate, etc.).

2. Other non-oxide single metal nanoparticles (e.g., Cu, Co, Fe, etc.).

3. Other non-oxide metal alloy and metal boride nanoparticles (eg. FePt, CoFe, Terfenol-D, galfenol, metglass, etc.).

4. Other metal oxide nanoparticles (e.g. iron oxide, cobalt ferrite, bismuth ferrite, etc.).

Furthermore, metal thin films (porous and dense) may be used in lieu of nanoparticles.

The system 10 has applications including, but not limited to: electric field assisted magnetic write in magnetic memory and a range of other spin based devices.

From the discussion above it will be appreciated that the invention can be embodied in various ways, including the following:

1. A magnetoelectric device, comprising: a superparamagnetic element; and a dielectric element coupled to the superparamagnetic element; wherein the superparamagnetic element is coupled to the dielectric element such that presence of an electric field switches the magnetic state of the superparamagnetic element between a superparamagnetic state and a substantially single-domain ferromagnetic state; and wherein the superparamagnetic state comprises substantially no overall net magnetization.

2. A magnetoelectric device as in any of the previous embodiments, wherein the device is configured to switch the magnetic state of the superparamagnetic element at room temperature.

3. A magnetoelectric device as in any of the previous embodiments, wherein the electric field is used to turn on and off a permanent magnetic moment of the device.

4. A magnetoelectric device as in any of the previous embodiments, wherein the superparamagnetic element is mechanically coupled to the dielectric element such that the presence of an electric field induces a strain between the superparamagnetic element and the dielectric element to switch the magnetic state.

5. A magnetoelectric device as in any of the previous embodiments: wherein the superparamagnetic element comprises a plurality of nanoparticles; and wherein the dielectric element comprises a substrate comprising a ferroelectric material mechanically coupled to the nanoparticles.

6. A magnetoelectric device as in any of the previous embodiments, wherein the dielectric element comprises a piezoelectric substrate.

7. A magnetoelectric device as in any of the previous embodiments, wherein the free layer comprises Ni nanocrystals embedded within a PT layer.

8. A magnetoelectric device as in any of the previous embodiments, wherein the substrate comprises PMN-PT mechanically coupled to the nanocrystals.

9. A magnetoelectric device as in any of the previous embodiments, wherein the substrate comprises upper and lower electrodes disposed on both sides of the substrate.

10. A magnetoelectric device as in any of the previous embodiments: wherein the upper electrode and the nanoparticles partially oxidize to promote adhesion; and wherein said adhesion is configured to facilitate strain transfer between the substrate and the nanoparticles.

11. A magnetoelectric device as in any of the previous embodiments, wherein the superparamagnetic element comprises a material having a non-zero magnetostriction configured such that any induced magnetoelastic anisotropy causes magnetic dipoles in the superparamagnetic element to align either parallel or perpendicular to a dominant compressive strain direction.

12. A multiferroic composite, comprising: a switchable superparamagnetic element having an electric-field-induced anisotropy; and a ferroelectric element coupled to the superparamagnetic element; wherein the superparamagnetic element is coupled to the ferroelectric element such that presence of an electric field switches the magnetic state of the superparamagnetic element between a superparamagnetic state and a substantially single-domain ferromagnetic state; and wherein the superparamagnetic state comprises substantially no overall net magnetization.

13. A composite as in any of the previous embodiments, wherein the composite is configured to switch the magnetic state of the superparamagnetic element at room temperature.

14. A composite as in any of the previous embodiments, wherein the electric field is used to turn on and off a permanent magnetic moment of the composite.

15. A composite as in any of the previous embodiments: wherein the superparamagnetic element comprises a first layer having a plurality of nanoparticles; wherein the ferroelectric element comprises a piezoelectric substrate; and wherein the superparamagnetic element is mechanically coupled to the piezoelectric substrate such that the presence of an electric field induces a strain between the superparamagnetic element and the dielectric element to switch the magnetic state.

16. A composite as in any of the previous embodiments, wherein the superparamagnetic element comprises Ni nanocrystals embedded within a PT layer.

17. A composite as in any of the previous embodiments, wherein the substrate comprises PMN-PT.

18. A composite as in any of the previous embodiments, wherein the substrate comprises upper and lower electrodes disposed on both sides of the substrate.

19. A composite as in any of the previous embodiments: wherein the upper electrode and the nanoparticles partially oxidize to promote adhesion; and wherein said adhesion is configured to facilitate strain transfer between the substrate and the nanoparticles.

20. A composite as in any of the previous embodiments, wherein the superparamagnetic element comprises a material having a non-zero magnetostriction configured such that any induced magnetoelastic anisotropy causes magnetic dipoles in the superparamagnetic element to align either parallel or perpendicular to a dominant compressive strain direction.

21. A composite as in any of the previous embodiments, wherein the composite is a component within a magnetic memory circuit.

22. A method for switching the magnetic state of a composite, comprising: providing a superparamagnetic element having an electric-field-induced anisotropy; mechanically coupling the superparamagnetic element to a ferroelectric element; and applying an electric field to the composite to switch a magnetic state of the superparamagnetic element between a superparamagnetic state and a substantially single-domain ferromagnetic state; wherein the superparamagnetic state comprises substantially no overall net magnetization.

23. A method as in any of the previous embodiments, wherein the magnetic state of the switchable layer is switched at room temperature.

24. A method as in any of the previous embodiments, wherein the electric field turns on and off a permanent magnetic moment of the switchable layer.

25. A method as in any of the previous embodiments: wherein the superparamagnetic element comprises a first layer having a plurality of nanoparticles; wherein the ferroelectric element comprises a piezoelectric substrate; and wherein the superparamagnetic element is mechanically coupled to the piezoelectric substrate such that the presence of an electric field induces a strain between the superparamagnetic element and the dielectric element to switch the magnetic state.

26. A method as in any of the previous embodiments, wherein the superparamagnetic element comprises Ni nanocrystals embedded within a PT layer, and wherein the substrate comprises PMN-PT.

27. A method as in any of the previous embodiments, wherein the substrate comprises upper and lower electrodes disposed on both sides of the substrate.

28. A method as in any of the previous embodiments: wherein the upper electrode and the nanoparticles partially oxidize to promote adhesion; and wherein said adhesion is configured to facilitate strain transfer between the substrate and the nanoparticles.

29. A method as in any of the previous embodiments, wherein the superparamagnetic element comprises a material having a non-zero magnetostriction configured such that any induced magnetoelastic anisotropy causes magnetic dipoles in the superparamagnetic element to align either parallel or perpendicular to a dominant compressive strain direction.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A magnetoelectric device, comprising:

a superparamagnetic element; and a dielectric element coupled to the superparamagnetic element;

wherein the superparamagnetic element is coupled to the dielectric element such that presence of an electric field switches the magnetic state of the superparamagnetic element between a superparamagnetic state and a substantially single-domain ferromagnetic state; and wherein the superparamagnetic state comprises substantially no overall net magnetization.

2. A magnetoelectric device as recited in claim 1, wherein the device is configured to switch the magnetic state of the superparamagnetic element at room temperature.

3. A magnetoelectric device as recited in claim 2, wherein the electric field is used to turn on and off a permanent magnetic moment of the device.

4. A magnetoelectric device as recited in claim 2, wherein the superparamagnetic element is mechanically coupled to the dielectric element such that the presence of the electric field induces a strain between the superparamagnetic element and the dielectric element to switch the magnetic state.

5. A magnetoelectric device as recited in claim 4:

wherein the superparamagnetic element comprises a plurality of nanoparticles; and wherein the dielectric element comprises a substrate comprising a ferroelectric material mechanically coupled to the nanoparticles.

6. A magnetoelectric device as recited in claim 5, wherein the dielectric element comprises a piezoelectric substrate.

7. A magnetoelectric device as recited in claim 6, wherein a free layer comprises Ni nanocrystals embedded within a PT layer.

8. A magnetoelectric device as recited in claim 7, wherein the substrate comprises PMN-PT mechanically coupled to the nanocrystals.

9. A magnetoelectric device as recited in claim 4, wherein the substrate comprises upper and lower electrodes disposed on both sides of the substrate.

10. A magnetoelectric device as recited in claim 9:

wherein the upper electrode and the nanoparticles partially oxidize to promote adhesion; and wherein said adhesion is configured to facilitate strain transfer between the substrate and the nanoparticles.

11. A magnetoelectric device as recited in claim 2, wherein the superparamagnetic element comprises a material having a non-zero magnetostriction configured such that any induced magnetoelastic anisotropy causes magnetic dipoles in the superparamagnetic element to align either parallel or perpendicular to a dominant compressive strain direction.

12. A multiferroic composite, comprising:

a switchable superparamagnetic element having an electric-field-induced anisotropy; and a ferroelectric element coupled to the superparamagnetic element;

wherein the superparamagnetic element is coupled to the ferroelectric element such that presence of an electric field switches the magnetic state of the superparamagnetic element between a superparamagnetic state and a substantially single-domain ferromagnetic state; and wherein the superparamagnetic state comprises substantially no overall net magnetization.

13. A composite as recited in claim 12, wherein the composite is configured to switch the magnetic state of the superparamagnetic element at room temperature.

14. A composite as recited in claim 13, wherein the electric field is used to turn on and off a permanent magnetic moment of the composite.

15. A composite as recited in claim 13:

wherein the superparamagnetic element comprises a first layer having a plurality of nanoparticles;

wherein the ferroelectric element comprises a piezoelectric substrate; and wherein the superparamagnetic element is mechanically coupled to the piezoelectric substrate such that the presence of an electric field induces a strain between the superparamagnetic element and the dielectric element to switch the magnetic state.

16. A composite as recited in claim 15, wherein the superparamagnetic element comprises Ni nanocrystals embedded within a PT layer.

17. A composite as recited in claim 16, wherein the substrate comprises PMN-PT.

18. A composite as recited in claim 15, wherein the substrate comprises upper and lower electrodes disposed on both sides of the substrate.

19. A composite as recited in claim 18:

wherein the upper electrode and the nanoparticles partially oxidize to promote adhesion; and wherein said adhesion is configured to facilitate strain transfer between the substrate and the nanoparticles.

20. A composite as recited in claim 13, wherein the superparamagnetic element comprises a material having a nonzero magnetostriction configured such that any induced magnetoelastic anisotropy causes magnetic dipoles in the superparamagnetic element to align either parallel or perpendicular to a dominant compressive strain direction.

21. A composite as recited in claim 13, wherein the composite is a component within a magnetic memory circuit.

* * * * *